US008534442B2

(12) United States Patent
Trenner et al.

(10) Patent No.: US 8,534,442 B2
(45) Date of Patent: Sep. 17, 2013

(54) MECHANICAL COIN CHECKING DEVICE HAVING A CONFIRMATION PHOTOELECTRIC BARRIER WHICH IS SECURE AGAINST MANIPULATION

(75) Inventors: Christian Trenner, Berlin (DE); Roland Griese, Berlin (DE)

(73) Assignee: Walter Hanke Mechanishche Werkstätten GmbH & Co. KG (DE)

( * ) Notice: Subject to any disclaimer, the term of this patent is extended or adjusted under 35 U.S.C. 154(b) by 0 days.

(21) Appl. No.: 13/440,604

(22) Filed: Apr. 5, 2012

(65) Prior Publication Data

US 2012/0255830 A1 Oct. 11, 2012

Related U.S. Application Data

(60) Provisional application No. 61/472,907, filed on Apr. 7, 2011.

(51) Int. Cl.
*G07F 1/00* (2006.01)
*G07F 1/04* (2006.01)

(52) U.S. Cl.
USPC ..... 194/244

(58) Field of Classification Search
USPC ..... 194/290, 292, 239, 244, 344; 193/DIG. 1
See application file for complete search history.

(56) References Cited

U.S. PATENT DOCUMENTS

| | | | | |
|---|---|---|---|---|
| 4,176,740 | A * | 12/1979 | Tzu-Yen | 194/244 |
| 4,936,436 | A * | 6/1990 | Keltner | 194/318 |
| 2006/0019591 | A1* | 1/2006 | Abe et al. | 453/18 |
| 2008/0054276 | A1* | 3/2008 | Vogel et al. | 257/84 |
| 2008/0299886 | A1* | 12/2008 | Enomoto | 453/3 |

* cited by examiner

*Primary Examiner* — Mark Beauchaine
(74) *Attorney, Agent, or Firm* — Schwegman Lundberg & Woessner, P.A.

(57) ABSTRACT

A mechanical coin checking device comprises a coin channel having a running rail, a coin acceptance shaft connected to the coin channel, a blocking element which is pivoted into the coin acceptance shaft if no coin is present and which, due to the weight thereof, pivots, after entry of a coin into the acceptance shaft, releases the acceptance shaft and blocks the coin channel at the same time, a confirmation photoelectric barrier which is disposed in the acceptance channel and detects the passage of a coin, an optical sensor for detecting the position of the blocking element and a control unit connected to the confirmation photoelectric barrier and to the optical sensor, the control unit, as a function of the signals of the confirmation photoelectric barrier and of the optical sensor, producing a credit signal for acceptance of the coin falling through the acceptance shaft.

20 Claims, 3 Drawing Sheets

MECHANICAL COIN CHECKING DEVICE HAVING A CONFIRMATION PHOTOELECTRIC BARRIER WHICH IS SECURE AGAINST MANIPULATION

CLAIM OF PRIORITY

This patent application claims the benefit of priority, under 35 U.S.C. §119(e), to U.S. Provisional Patent Application Ser. No. 61/472,907, entitled "MECHANICAL COIN TESTER WITH TAMPER-PROOF PHOTO BARRIER," filed on Apr. 7, 2011, which is hereby incorporated by reference herein in its entirety.

TECHNICAL HELD

The present subject matter relates to a mechanical coin checking device for checking and detecting coins introduced into an insertion slot.

BACKGROUND

Mechanical coin checking devices are generally known and their construction consists of a basic body in which a coin running channel is disposed and which abuts against a coin slot. A plurality of checking sensors is disposed on the coin running channel, i.e. in the walls thereof, which check for example the dimensions of the coin and the metallic properties. If a coin has been detected as genuine, it is conducted from the coin channel into an acceptance channel which is connected to a cash box and at which a confirmation photoelectric barrier is disposed, which detects the passage of a coin to be conducted into the cash box and emits a so-called credit signal to an automatic machine control, i.e. to a control which controls the course of the processes in an automatic machine, such as a vending machine or for example an automatic washing machine in which the coin checking device is disposed. If a coin has been detected as not being genuine by the checking devices, is conducted into a return channel.

In order to avoid manipulation and interventions by foreign objects, blocking elements are disposed in the region of the coin channel and prevent the introduction of foreign objects, such as wire elements, cardboard strips or the like, which are intended to affect the confirmation photoelectric barrier. However, it has been shown that the blocking elements present do not suffice for all fraudulent possibilities, it has been shown for example that manipulation is possible, despite the blocking elements, with soft flexible objects.

SUMMARY

Accordingly, certain examples provide a measure on mechanical coin checking devices which makes available an "intelligent lock" and reduces manipulation on the coin checking device.

This is achieved according to various examples by a mechanical coin checking device which, in the known manner, includes a blocking element which is pivoted into the acceptance shaft for coins if no coin is present and which, due to the weight thereof, pivots, after entry of a coin into the acceptance shaft, out of the channel and releases the acceptance shaft and thereby blocks the coin channel at the same time. This normally represents a lock for the coin. Furthermore, a confirmation photoelectric barrier is provided, Which is disposed in the acceptance channel and detects the passage of a coin by breaking the photoelectric barrier. According to various examples, a further optical sensor which cooperates with the blocking element and detects the position of the blocking element is provided in the region of the acceptance channel. Finally, a control unit which is connected to the confirmation photoelectric barrier and to the optical sensor is disposed in the region of the acceptance shaft, the control unit, as a function of the signals of the confirmation photoelectric barrier and of the optical sensor, producing a credit signal for acceptance of the coin which has fallen through the acceptance shaft. It is possible by means of these described measures to make available an "intelligent lock" in which a credit signal for passage of a coin is produced only when the temporal sequence of pivoting of the blocking element is followed.

According to the present subject matter, the control unit, the confirmation photoelectric barrier and the optical sensor which can be configured as a photoelectric barrier or as reflex coupler are disposed on a carrier part which is connected to the wall of the acceptance shaft. Hence retrofitting for the mechanical coin checking devices which are present can be undertaken since merely the confirmation photoelectric barrier which is respectively present and mounted on a carrier part can be replaced by the confirmation photoelectric barrier with control unit and optical sensor for position detection according to the present subject matter.

Preferably, the elements control unit, confirmation photoelectric barrier and optical position sensor are mounted on a printed circuit board which is connected electrically to the automatic machine control and forms a component of the carrier part. Thus the dimensions of the carrier part are kept small and reliable electrical contacting of the electrical elements is ensured.

BRIEF DESCRIPTION OF THE DRAWINGS

One embodiment of the present subject matter is represented in the drawing and is explained in more detail in the subsequent description. There are shown FIGS. 1*a*) to 1*d*) a perspective schematic partial view of the coin running channel having blocking element and confirmation photoelectric barrier on the acceptance shaft if a coin is inserted into the coin channel, FIGS. 2*a*) to 2*d*) a perspective schematic partial view of the coin running channel having blocking element and confirmation photoelectric barrier on the acceptance shaft if a coin is conducted from the coin channel into the acceptance shaft, and FIGS. 3*a*) and 3*b*) a view of the carrier part having confirmation photoelectric barrier, optical sensor and control unit in side view and in plan view.

DETAILED DESCRIPTION

Figure 1:
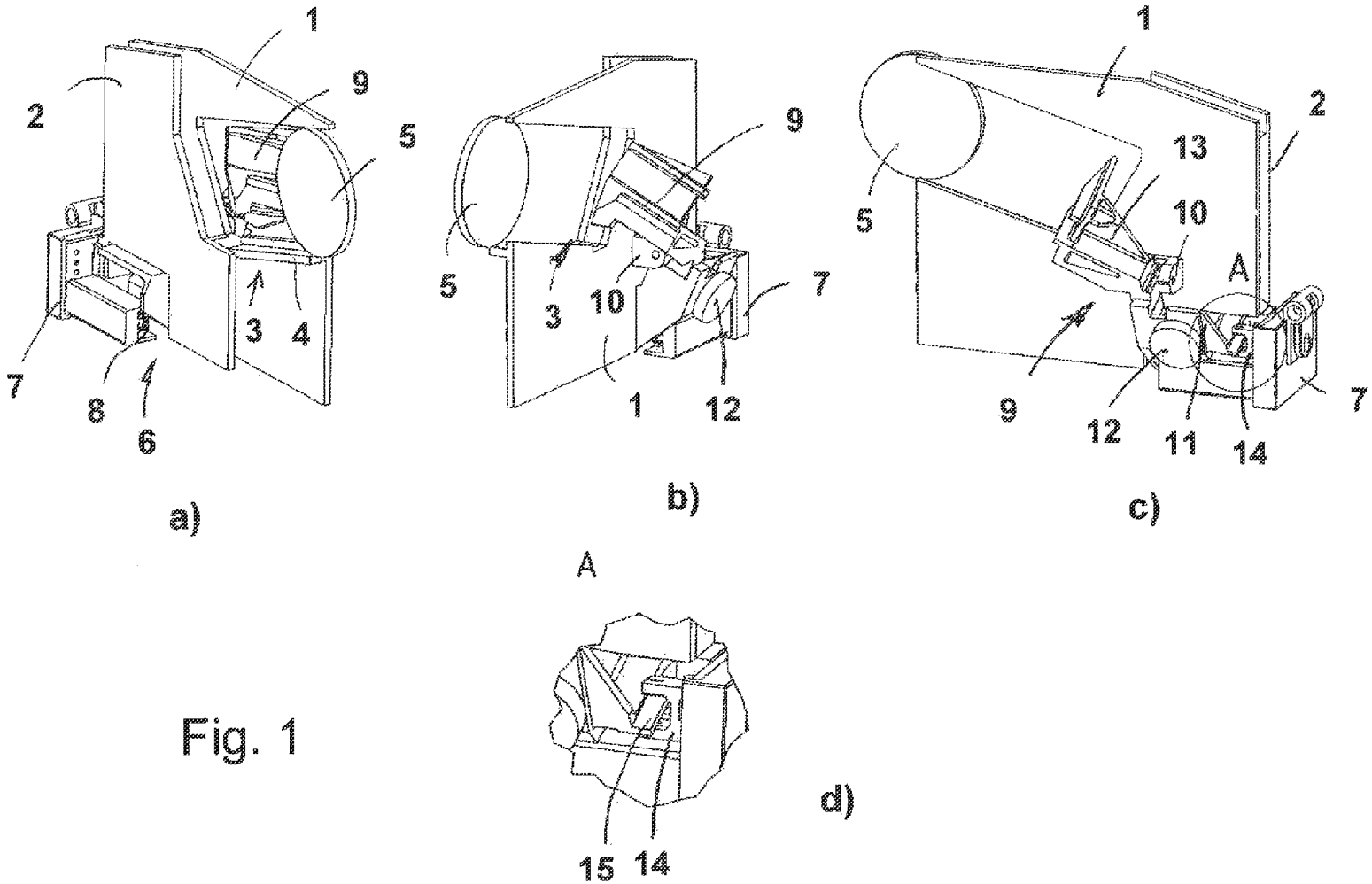

In FIGS. 1*a*) to 1*c*), components of a mechanical coin checking device are represented schematically, a coin channel 3 formed between two walls 1, 2 of a basic body of the coin checking device being able to be detected. The coin channel 3 comprises a running rail 4 on which a coin 5 which is introduced into an insertion slot, not represented, can roll. An acceptance channel 6 abuts against the coin channel 3, from which acceptance channel an "accepted coin" possibly moves into a cash box via conveyance channels. A carrier part 7 is mounted on the acceptance channel 6 or on the walls thereof 2, 1 and serves for receiving a bifurcated photoelectric barrier 8, the optical sensor and receiver of which are disposed on both sides of the acceptance channel 6.

In order to reduce manipulation, a pivotable blocking element 9 is mounted on the wall 1, as can be detected readily in FIGS. 1*b*) and 1*c*), which blocking element forms a sort of rocker which is pivoted out of the coin channel 3 in the non-operative state corresponding to FIG. 1 by one arm and, on the other hand, extends with the second arm into the acceptance channel 6 and blocks the latter. The pivot point of the blocking element is designated with 10 and a weight 12 for counterbalance is disposed on the arm 11 which extends by its end into the acceptance channel 6. As was already explained, the arm 13 of the blocking element 9 does not extend into the coin channel 3 when a coin 5 is inserted.

As can be detected in more detail in FIG. 1*d*), which represents the portion A circled in FIG. 1*c*) in an enlarged manner, a positioning photoelectric barrier 14 is disposed on the carrier part 7, the detection stretch of which is orientated vertically, i.e. in the direction of a coin 5 falling into the acceptance channel, a vane 15 which is connected to the arm 11, in the non-operative position of the blocking element 9, interrupting the optical detection stretch of the positioning photoelectric barrier 14.

Figure 2:
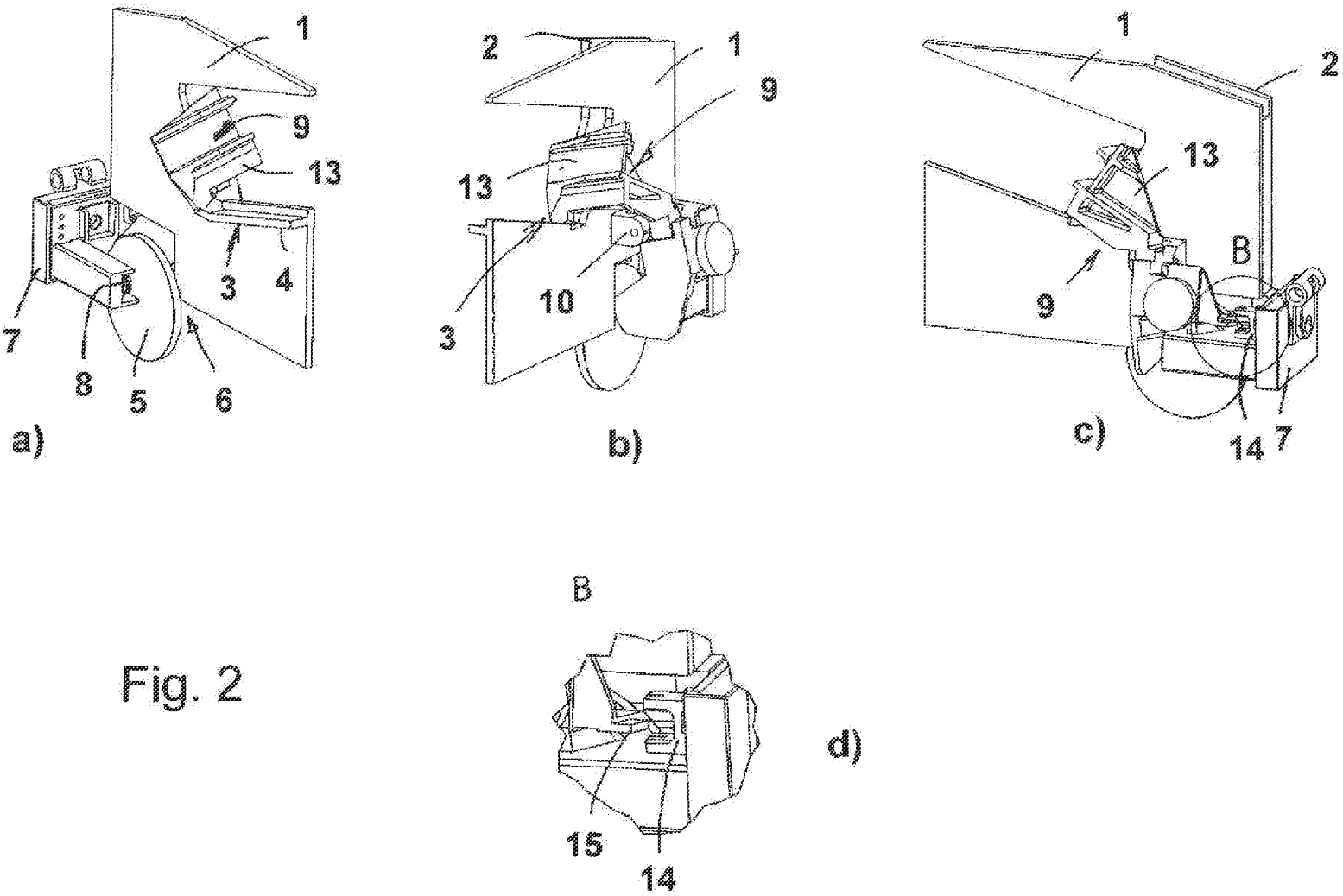

FIG. 2 corresponds to FIG. 1, except that a coin 5 has reached the acceptance shaft 6, the blocking element 9 pivoting about the bearing point 10 due to the weight of the coin in such a manner that the arm 11 of the blocking element is pushed away from the acceptance channel 6 and the opposite arm 13 engages in the coin channel. This means that, during the confirmation process, no further coins move into the acceptance shaft. By pivoting the blocking element 9, also the vane 15 is moved out of the detection region of the positioning photoelectric barrier 14, as a result of which the receiver of the photoelectric barrier 14 can receive the beam emitted from the transmitter.

Figure 3:
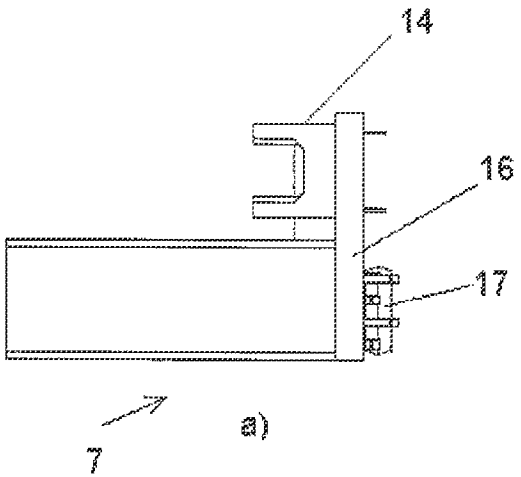
Figure 3:
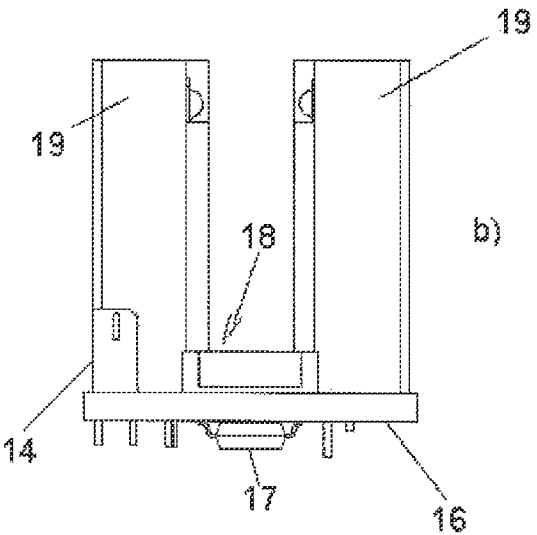

In FIG. 3, the carrier part 7 is represented, and in fact in side view in FIG. 3*a*) and in plan view in FIG. 3*b*). The carrier part 7 has a printed circuit board 16 which serves as carrier of a microprocessor 17 which is connected thereto and serves as control unit and serves for the positioning photoelectric barrier 14. A plastic material part 18 with two hollow projections 19 which are disposed at a spacing relative to each other is mounted on the printed circuit board 16, the intermediate space serving for passage of the coin 5. The transmitter and receiver of the bifurcated photoelectric barrier 8 are disposed in the hollow projections 19. The transmitter and receiver of the bifurcated photoelectric barrier 8 of the positioning photoelectric barrier 14 are connected electrically to the microprocessor 17 via corresponding lines on the printed circuit board 16, and the microprocessor 17 is connected to an automatic machine control, not represented. The microprocessor is designed with respect to programming technology such that it receives a signal from the bifurcated photoelectric barrier 8 during passage which is produced by said photoelectric barrier when a coin 5 is passing through. In a corresponding manner, the microprocessor receives signals from the positioning photoelectric barrier 14 which indicate whether the vane 15 is situated inside the detection stretch or not. As a function of these signals, the microprocessor 17 produces a credit signal for acceptance of a coin if the temporal sequence of the signals indicates that the blocking element has been pivoted out of the positioning photoelectric barrier, the confirmation photoelectric barrier produces a passage signal and, within a specific time, the blocking element pivots again into the detection region of the positioning photoelectric barrier 14.

In summary, the course is intended to be described once again.

A coin 5 is inserted in the coin channel 3 of the coin checking device and is intended to be confirmed upon exit or entry into the acceptance shaft 6 since it is a genuine coin. The coin 5 rolls in the direction of the acceptance shaft 6 and falls, due to its gravity, onto the lever-like end 11 of the blocking element 9 which is situated above the bifurcated photoelectric barrier 8. The blocking element 9 pivots out of the acceptance shaft 6, moves away from the vertically situated positioning photoelectric barrier, i.e. the vane 15 pivots out, and closes with the arm 13 or with its end the coin channel 3 and hence the acceptance shaft 6. The coin 5 falls through the bifurcated photoelectrical barrier 8. Due to the weight 12 disposed on the blocking element 9, the blocking element pivots back into its non-operative state and interrupts the vertical detection stretch of the positioning photoelectric barrier.

The blocking element has the function of a "lock" for coins. As soon as a coin 5 is situated in the acceptance shaft 6, it blocks the passage to the acceptance shaft 6 and to the confirmation photoelectric barrier. Without the blocking element 9, the confirmation photoelectric barrier 8 could be actuated with a wire or the like. Since however it was established, that manipulation with soft flexible objects was possible despite this "lock" formed by the blocking element 9, the additional positioning photoelectric barrier 14 and the microprocessor are provided, by means of which an "intelligent lock" can be produced. A credit signal is hence only produced if the following rule is followed:

- the coin 5 falls onto the end of the arm 11 of the blocking element and opens the positioning photoelectric barrier 14,
- the coin falls through the confirmation photoelectric barrier 8, and again releases the blocking element 9,
- within a specific time, e.g. 300 ms, the blocking element must move again into its non-operative position.

If an object is situated in the "lock", this time is in any case exceeded and no credit signal is produced by the microprocessor 17. If the blocking element moves into the non-operative position in the prescribed time, such a credit signal is produced.

What is claimed is:

1. A mechanical coin checking device, comprising:

a coin channel including a running rail for a coin to roll on;

a coin acceptance shaft connected to the coin channel;

a blocking element adapted to pivot into the coin acceptance shaft if no coin is present and which, due to the weight thereof, is adapted to pivot, after entry of a coin into the acceptance shaft, and to release the acceptance shaft and block the coin channel at the same time;

a confirmation photoelectric barrier which is disposed in the acceptance shaft, such that a coin inserted into the coin channel reaches the confirmation photoelectric barrier after it has already passed the blocking element, wherein the confirmation photoelectric barrier is adapted to detect the passage of a coin;

an optical sensor adapted to detect the position of the blocking element; and a control unit which is connected to the confirmation photoelectric barrier and to the optical sensor and is disposed in the region of the acceptance shaft, the control unit being adapted to receive signals of the confirmation photoelectric barrier and of the optical sensor and to produce a credit signal as a function of the signals of the confirmation photoelectric barrier and of the optical sensor, the credit signal indicating an acceptance of a coin and a passage of the accepted coin through the acceptance shaft.

2. The coin checking device according to claim 1, wherein the control unit, confirmation photoelectric barrier and optical sensor are disposed on a carrier part which is connected to at least one wall of the acceptance shaft.

3. The coin checking device according to claim 2, wherein the control unit, confirmation photoelectric barrier and optical sensor are disposed on a printed circuit board which is connected to the carrier part.

4. The coin checking device according to claim 2, wherein the control unit, confirmation photoelectric barrier and optical sensor are disposed on a printed circuit board is a component of the carrier part.

5. The coin checking device according to claim 1, wherein the control unit is a microprocessor.

6. The coin checking device according to claim 1, wherein the optical sensor is configured as a photoelectric barrier.

7. The coin checking device according to claim 6, wherein the photoelectric barrier forming the optical sensor is disposed vertically.

8. The coin checking device according to claim 1, wherein the credit signal is only produced when the blocking element moves again into its non-operative position which is established by the optical sensor after pivoting out of the acceptance shaft due to the weight of the coin after a prescribed time.

9. The coin checking device according to claim 1, wherein the control unit is a microcontroller.

10. The coin checking device according to claim 1, wherein the optical sensor is configured as a reflex coupler.

11. A mechanical coin checking device, comprising:

a coin channel including a running rail for a coin to roll on;

a coin acceptance shaft connected to the coin channel;

a blocking element adapted to pivot into the coin acceptance shaft when no coin is present and which, due to the weight thereof, is adapted to pivot, upon entry of a coin into the acceptance shaft, and to release the acceptance shaft and block the coin channel at the same time;

a confirmation photoelectric barrier which is disposed in the acceptance shaft, such that a coin inserted into the coin channel reaches the confirmation photoelectric barrier after it has already passed the blocking element, wherein the confirmation photoelectric barrier is adapted to detect the passage of a coin;

an optical sensor adapted to detect the position of the blocking element; and a control unit which is connected to the confirmation photoelectric barrier and to the optical sensor and is disposed in the region of the acceptance shaft, the control unit being adapted to receive signals of the confirmation photoelectric barrier and of the optical sensor to produce a credit signal as a function of the signals of the confirmation photoelectric barrier and of the optical sensor, the credit signal indicating an acceptance of a coin and a passage of the accepted coin through the acceptance shaft.

12. The coin checking device according to claim 11, wherein the control unit, confirmation photoelectric barrier and optical sensor are disposed on a carrier part which is connected to at least one wall of the acceptance shaft.

13. The coin checking device according to claim 12, wherein the control unit, confirmation photoelectric barrier and optical sensor are disposed on a printed circuit board which is connected to the carrier part.

14. The coin checking device according to claim 12, wherein the control unit, confirmation photoelectric barrier and optical sensor are disposed on a printed circuit board which is a component of the carrier part.

15. The coin checking device according to claim 11, wherein the control unit is a microprocessor.

16. The coin checking device according to claim 11, wherein the control unit is microcontroller.

17. The coin checking device according to claim 11, wherein the optical sensor is configured as a photoelectric barrier.

18. The coin checking device according to claim 11, wherein the optical sensor is configured as a reflex coupler.

19. The coin checking device according to claim 18, wherein the photoelectric barrier forming the optical sensor is disposed vertically.

20. The coin checking device according to claim 11, wherein the credit signal is only produced when the blocking element moves again into its non-operative position which is established by the optical sensor upon pivoting out of the acceptance shaft due to the weight of the coin after a prescribed time.

* * * * *